US007708563B2

(12) United States Patent
Block et al.

(10) Patent No.: US 7,708,563 B2
(45) Date of Patent: May 4, 2010

(54) ELECTRICAL CONNECTOR WITH SLOTTED SHIELD

(75) Inventors: Michael J. Block, Carlisle, PA (US); Kevin E. Weidner, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 134 days.

(21) Appl. No.: 12/141,383

(22) Filed: Jun. 18, 2008

(65) Prior Publication Data

US 2009/0318023 A1 Dec. 24, 2009

(51) Int. Cl.
*H01R 12/00* (2006.01)

(52) U.S. Cl. ..... 439/63

(58) Field of Classification Search ..... 439/63, 439/581, 607.35, 607.4, 578, 323, 94, 95
See application file for complete search history.

(56) References Cited

U.S. PATENT DOCUMENTS 3,745,514 A 7/1973 Brishka
3,828,303 A 8/1974 Sladek et al.
4,884,982 A * 12/1989 Fleming et al. ..... 439/620.03
5,062,811 A * 11/1991 Hackman ..... 439/620.03
6,036,545 A * 3/2000 Caviness et al. ..... 439/620.1
6,827,608 B2 12/2004 Hall et al.
7,014,480 B1 * 3/2006 Weidner et al. ..... 439/95

OTHER PUBLICATIONS

Tyco Electronics Product Details, 16 pages.

* cited by examiner

*Primary Examiner*—Neil Abrams
*Assistant Examiner*—Harshad C Patel

(57) ABSTRACT

A connector housing includes a housing and a shield. The housing has an interior chamber extending between housing mating and back ends. The inner surface has loading and transition portions, with the loading portion located proximate to the housing mating end and the transition portion located proximate to the housing back end. The shield is shaped to fit in the interior chamber and extends between a shield mating end and a shield back end. The shield back end includes a ground contact opening. The shield includes a rim protruding from the shield back end that extends around a portion of an outer periphery of the shield back end. The rim includes a plurality of rim ends separated by a gap. The rim engages the transition portion to prevent the shield being removed through the housing mating end and the gap exposes a portion of the transition portion.

20 Claims, 5 Drawing Sheets

ELECTRICAL CONNECTOR WITH SLOTTED SHIELD

BACKGROUND OF THE INVENTION

The subject matter herein relates generally to electrical connectors, and more particularly, to electrical connectors having an electromagnetic ("EM") shield.

Some known electrical connectors, include a shield disposed within a housing. A portion of the shield may protrude from one cud of the housing. For example, a rim extending entirely around a periphery of one end of the shield may partially protrude from the housing. A pair of openings in the shield that are surrounded by the rim may be provided for a signal contact and a ground contact. For example, the signal contact (nay be inserted through, one of the openings and may pass through the shield and the housing to a mating end of the connector. A second opening may receive a ground contact that is electrically connected to an electrical ground. The ground contact may then connect the shield to the electrical ground.

The shield may be secured in the housing by bending, or flaring, the rim away from the pair of openings and towards the housing. The rim is bent towards the housing and engages the housing to prevent separation of the shield from the housing. For example, the housing and shield may each have shapes with substantially cylindrical inner chambers between opposing ends. The shield may be inserted into one end of the housing with the rim protruding from an opposing end of the housing. The rim may be flared towards the housing at this opposing end to prevent the shield from being pulled through the housing.

The rim, however, also can present problems in the manufacture and tooling processes involved in manufacturing the shield. In one example, the rim may prevent flash or waste material from being removed from the shield. For example, if the shield is fabricated through a die casting process, the conductive material used to create the shield may be heated so the material is liquid or molten and then pressure injected into a mold. A pin or bit may be inserted into the liquid material in the mold to create the opening for the ground contact. As the liquid material cools and solidifies, the pin is removed froth the mold and the conductive material. As the pin is removed, the pin may pull waste material such as flash and partially solidified conductive material from the opening for the ground contact onto the shield and within the rim. This waste material may then solidify as metallic silvers. Alternatively, the waste silvers may be created by drilling or punching the opening for the ground contact after the shield has been formed. The rim prevents all of these slivers from being removed from the shield because the rim entirely encircles the end of the shield. These waste slivers may dislodge from the shield or rim and contact electronic equipment that is near the connector assembly,. For example, the waste slivers may dislodge from the shield and contact another electrical connector, a conductive trace, and the like, on the circuit board to which the connector is mounted. The slivers may cause electric shorts or cause other damage to the electronic equipment. Thus, a need exists for an electrical connector with a shield that does not retain flash or other waste generated during the manufacture of the shield.

BRIEF DESCRIPTION OF THE INVENTION in One embodiment, an electrical connector housing includes a housing and a shield. The housing has an interior chamber that includes an inner surface extending between a housing mating end and a housing back end. The housing mating end is configured to mate with a mating electrical connector. The inner surface has loading and transition portions, with the loading portion located proximate to the housing mating end and the transition portion located proximate to the housing back end. The shield is shaped to fit in the interior chamber and extends between a shield mating end and a shield back end. The shield back end includes a ground contact opening that is configured to receive a ground contact to electrically connect the shield to an electrical ground. The shield includes a rim protruding from the shield back end that extends around a portion of an outer periphery of the shield back end. The rim includes a plurality of rim ends separated by a gap. The rim engages the transition portion to prevent the shield being removed through the housing mating end and the gap exposes a portion of the transition portion.

In another embodiment, another electrical connector assembly includes a housing, a shield, a dielectric holder and a signal contact. The housing includes an interior chamber that extends along a longitudinal axis between a housing mating end and a housing back end. The housing mating end is configured to mate with a mating electrical connector. The shield is shaped to fit in the interior chamber and extends along the longitudinal axis between a shield mating end and a shield back end. The shield back end includes a ground contact opening that is configured to receive a ground contact to electrically connect the shield to an electrical ground. The shield includes a rim protruding from the shield back end that extends around a portion of an outer periphery of the shield back end. The rim includes a plurality of rim ends separated by a gap located proximate to the ground contact opening. The dielectric holder is held within the shield and extends along the longitudinal axis. The signal contact is held within the dielectric holder and substantially extends along the longitudinal axis. Each of the housing, shield, dielectric holder and signal contact are coaxial with one another about the longitudinal axis.

DETAILED DESCRIPTION OF THE INVENTION

Figure 1:
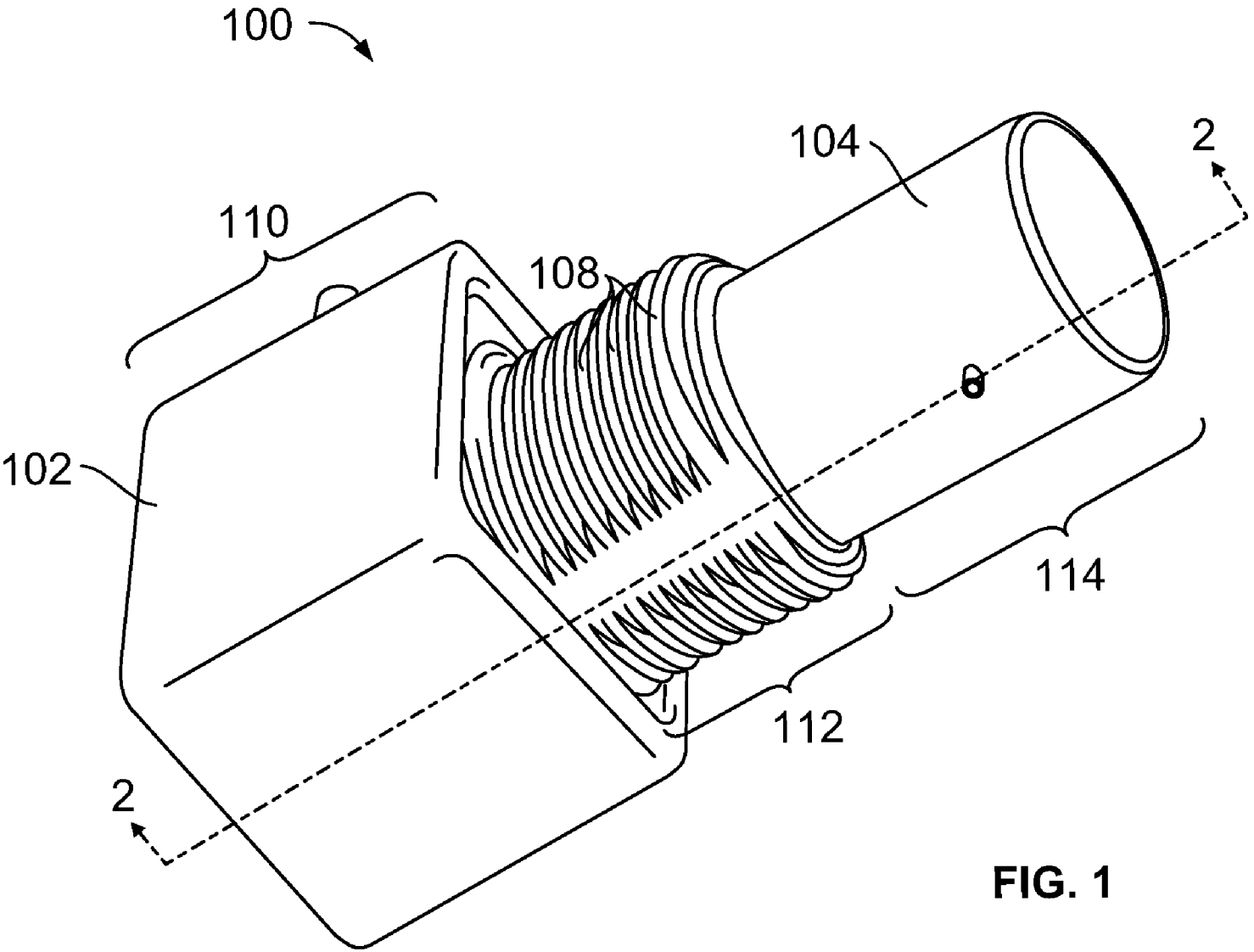
FIG. 1 is a perspective view of an electrical connector assembly according to one embodiment.

FIG. 1 is a perspective view of an electrical connector assembly 100 according to one embodiment. The connector assembly 100 includes a housing 102 and a shield 104, with the shield 104 being partially held within the housing 102. A dielectric 200 (shown in FIG. 2) and a signal contact 202 (shown in FIG. 2) are held within the shield 104. In one embodiment, the connector assembly 100 is an RF connector. For example, the signal contact 202 may be an electrical contact capable of carrying a data or power signal.

The shield 104 may shield the connector assembly 100 from electromagnetic interference. The shield 104 comprises, is formed of, or has an outside surface that is coated with a conductive material. For example, the shield 104 may be formed of zinc, copper or an alloy containing copper. Other conductive metals, however, can be used in alternative embodiments. For example, the shield 104 may be formed of a die cast metal. In one embodiment the shield 104 has a conductive coating. For example, the shield 104 may be plated with a conductive material such as nickel. The shield 104 may be formed using a variety of processes, including a screw machining process or a die casting process, for example.

The housing 102 is formed from a nonconductive material. For example, the housing 102 maybe formed from a plastic material such as polyester polybutylene terephthalate ("PBT"). In alternative embodiments, the housing 102 may be formed from, or have an outside surface that is coated with, a conductive material. For example, the housing 102 may be formed from a metal or metal alloy, and may be a die east metal. The housing 102 has a housing mating end 112 and the shield 104 has a shield mating end 114. The housing and shield mating ends 112, 114 are shaped to mate with a mating connector (not shown). In the illustrated embodiment, the housing and shield mating ends 112, 114 are shaped to mate with a female mating connector. In another embodiment, the housing and shield mating ends 112, 114 are shaped to receive a mating end (not shown) of the mating connector. The housing mating end 112 may include threads 108 to enable a secure engagement with the mating connector. The shield mating end 114 may be received within the mating connector when the connector assembly 100 and the mating connector mate. The housing 102 also includes a housing mounting end 110 that is mounted onto a panel (not shown) or circuit board (not shown) of a device (not shown). For example, the housing mounting end 110 may be mounted on a circuit board and the signal contact 202 (shown in FIG. 2) in the connector assembly 100 may be terminated to a conductive trace (not shown) in the circuit board. While the housing mounting end 110 and the housing mating end 112 are substantially perpendicular to one another in the illustrated embodiment, the housing mounting and mating ends 110, 112 may be at a different angle with respect to one another. For example, the housing mounting and mating ends 110, 112 may be parallel to one another. The connector assembly 100 may provide a conductive pathway between the mating connector and the circuit board when the connector assembly 100 is mated with the mating connector and mounted on the circuit board, for example.

Figure 2:
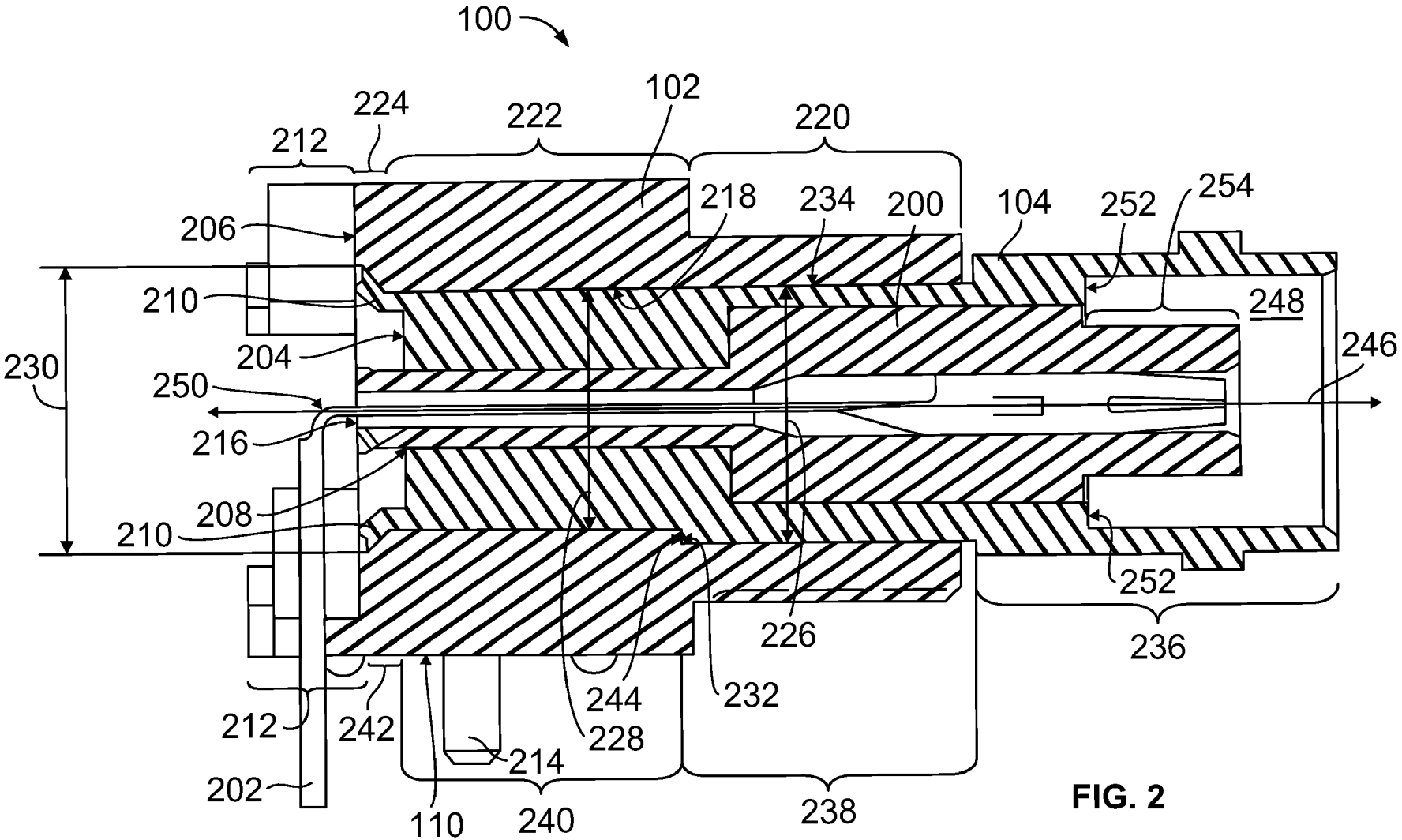
FIG. 2 is a cross sectional view of the connector assembly shown in FIG. 1 taken along line 2-2 in FIG. 1.

FIG. 2 is a cross sectional view of the connector assembly 100 taken along line 2-2 in FIG. 1. The housing 102 extends between the housing mating end 112 (shown in FIG. 1) and a housing back end 206. A housing mounting end 110 is substantially perpendicular to the housing mating and back ends 112, 206 in the illustrated embodiment. In another embodiment, the housing mounting end 110 is not perpendicular to the housing mating and back ends 112, 206. A mounting pin 214 extends downwards from the housing mounting end 110. The mounting pin 214 may be mounted onto a circuit board (not shown) or panel (not shown) to mount the connector assembly 100 to the circuit board or panel, for example. The shield 104 extends between the shield mating end 114 and a shield back, end 204. In the illustrated embodiment, the shield mating and back ends 114, 204 are parallel to one another. In another embodiment, the shield mating and back ends 114, 204 are substantially perpendicular to one another. In another embodiment, the shield mating and back ends 114, 204 are not parallel or perpendicular to one another. The term "back" is not intended to be limiting and merely identifies the relationship between the shield mating and back ends 114, 204 and between the housing mating and back ends 112, 206.

The housing 102 includes an interior chamber defined by an inner housing surface 218. In one embodiment the inner housing surface 218 has a cylindrical shape that is staged in diameter to form a loading portion 220, a back portion 222 and a transition portion 224. The loading portion 220 may correspond to the housing mating end 112 (shown in FIG. 1). In one embodiment, a shoulder 232 separates the loading and back portions 220, 222. The inner housing surface 218 has an inside diameter 226 within the loading portion 220 and an inside diameter 228 within the back portion 222. The transition portion 224 comprises a beveled edge in the illustrated embodiment. The transition portion 224 has an inside diameter that gradually changes from an inside diameter 230 at the housing back end 206 to the inside diameter 228 at the interface between the back portion 222 and the transition portion, 224. In the illustrated embodiment, the inside diameter 226 of the loading portion 220 is larger than the inside diameter 228 of the back portion 222. In one embodiment, the inside diameter 230 of the transition portion 224 at the housing back end 206 is larger than either of the inside diameters 226, 228 of the loading and back portions 220, 222.

Figure 3:
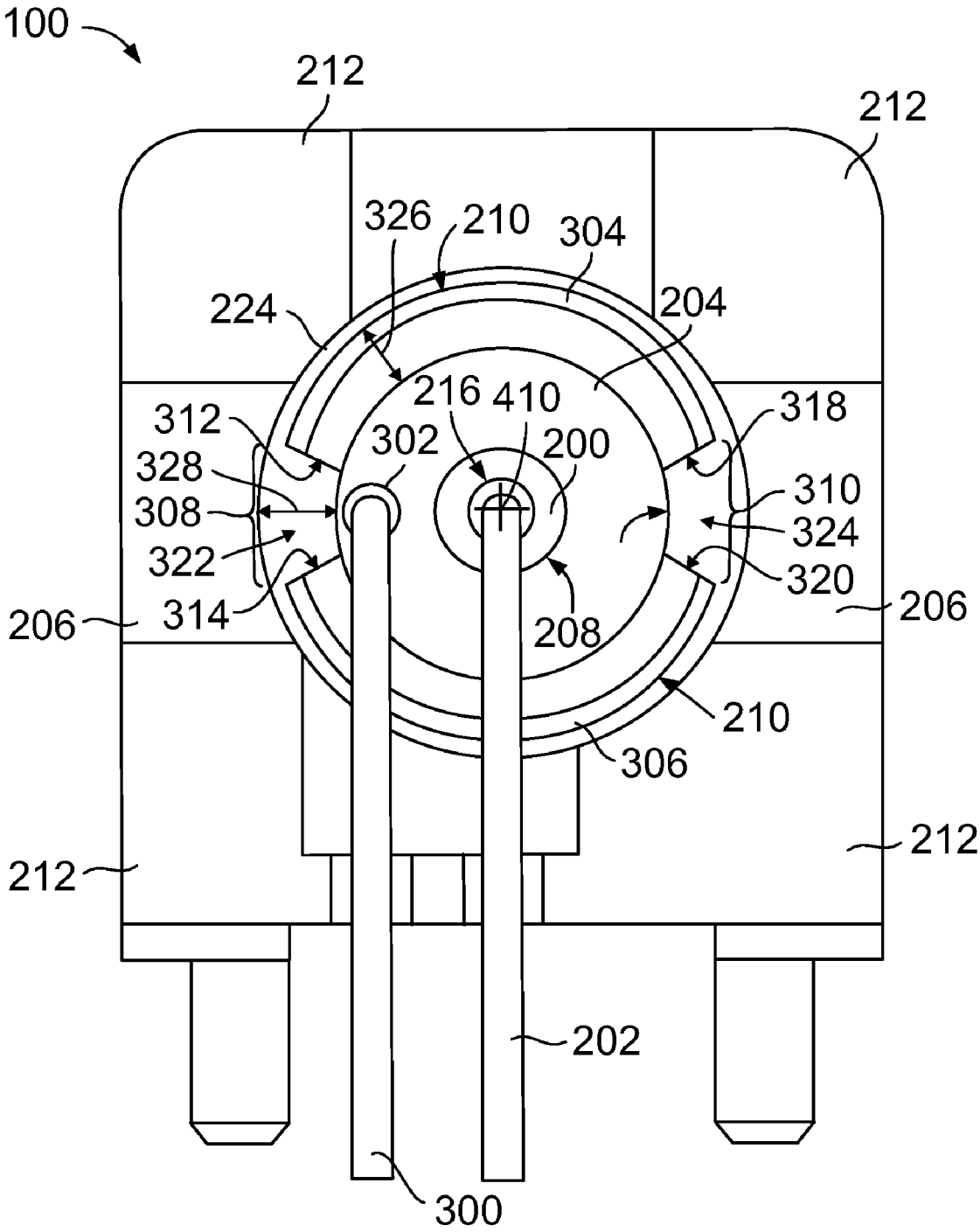
FIG. 3 is an elevational view of shield and housing back ends shown in FIG. 2 of the connector assembly.

The housing 102 may include one or more extended housing portions 212 that extend away from the housing back end 206. One or more of the extended housing portions 212 may hold the signal contact 202 between the shield back end 204 and the housing mounting end 110. For example, one of the extended housing portions 212 may hold and protect the portion of the signal contact 202 between the shield back end 204 and the housing mounting end 110. As shown in FIG. 3, one or more of the extended housing portions 212 may hold a ground contact 300 between the shield back end 204 and the housing mounting end 110 in a manner similar to that of the signal contact 202. The ground contact 300 may establish a conductive pathway between the shield 104 and an electrical ground of the circuit board (not shown), panel (not shown), device (not shown), and the like, to which the connector assembly 100 is mounted.

The shield 104 is held in the housing 102 and includes an outer shield surface 234. In one embodiment, the outer shield surface 234 has a cylindrical shape that is staged in diameter to form a mating portion 236, a front intermediate portion 238, a rear intermediate portion 240, and a rim portion 242. The mating portion 236 may correspond to the shield mating end 114. In one embodiment, a shoulder 244 separates the front and rear intermediate portions 238, 240. The outer shield surface 234 of the front intermediate portion 238 may have an outside diameter that is approximately the same as the inside diameter 226 of the inner housing surface 218 in the loading portion 220. The outer shield surface 234 of the rear intermediate portion 240 may have an outside diameter that is approximately the same as the inside diameter 228 of the inner housing surface 218 in the back portion 222. The outer shield surface 234 of the rim portion 242 may have an outside diameter that is shaped to engage the inside diameter 230 of the inner housing surface 218 in the transition portion 224. The shield 104 may include an inner ledge 252 in the mating portion 236.

The shield 104 may be inserted, or loaded, into the interior chamber of the housing 102 through the housing mating end 112. In one embodiment, the shoulder 244 of the shield 104 engages the shoulder 232 of the housing 102 to prevent the shield 104 from being inserted into the housing 102 past the shoulder 232. The shield back end 204 includes a rim 210 that protrudes from the shield back end 204. In one embodiment, the rim 210 includes the rim portion 242 of the outer shield surface 234. In the illustrated embodiment, the rim 210 is flared towards the housing back end 206 so that the rim 210 engages the housing back end 206. For example, the rim 210 may extend radially outward from a longitudinal axis 246 of the connector assembly 100. The outer shield surface 234 of the rim portion 242 may have an outside diameter that is approximately the same as the outside diameter of the outer shield surface 234 of the rear intermediate portion 240 when the shield 104 is loaded into the housing 102. The rim 210 may be flared towards the inner housing surface 218 of the transition portion 224 so that the rim 210 engages the transition portion 224. The outside diameter of the rim portion 242 thus accordingly increases to approximate the inside diameter 230 of the transition portion 224 when the rim 210 is flared. The rim 210 engages the housing back end 206 so as to impede removal of the shield 104 from the housing 102 through the housing mating end 112.

The dielectric 200 extends through an interior chamber 248 of the shield 104. The interior chamber 248 may extend through the shield 104 from the shield mating portion 236 of the outer shield surface 234 to the shield back end 204. In one embodiment, the dielectric 200 includes a nose portion 254. In the illustrated embodiment, the nose portion 254 protrudes from a location that is proximate to the inner ledge 252 of the shield 104 in the mating portion 236 of the shield 104. In another embodiment, the dielectric 200 does not protrude past the inner ledge 252. For example, the dielectric 200 may not include the nose portion 254 or the nose portion 254 may not extend past the inner ledge 252. The dielectric 200 may protrude through a dielectric holder opening 208 in the shield back end 204. The dielectric 200 may be a ring of a dielectric or insulating material with an open center that receives the signal contact 202. The signal contact 202 may extend through the dielectric 200 and protrude through a signal contact opening 216 in the dielectric 200. The signal contact 202 may include a bend 250 proximate to and outside of the dielectric 200. In the illustrated embodiment, the bend 250 is approximately 90 degrees. In one embodiment, the housing 102, shield 104, dielectric 200 and signal contact 202 are substantially coaxial with one another about the longitudinal axis 246 of the connector assembly 100.

FIG. 3 is an elevational view of the shield and housing back ends 204, 206 of the connector assembly 100. In the illustrated embodiment, the extended housing portion 212 extends from the housing back end 206 while leaving a portion of the housing back end 206 exposed. In another embodiment, the extended housing portion 212 is omitted from the connector assembly 100. The shield back end 204 includes the dielectric holder opening 208 and a ground contact opening 302 surrounded by an outside periphery 316 of the shield back end 204. The ground contact opening 302 is a cavity or opening in the shield back end 204 into which the ground contact 300 is inserted. The ground contact 300 may be terminated to the shield back end 204 through the ground contact opening 302. For example, the ground contact 300 may be affixed into the ground contact opening 302. The longitudinal axis 246 (shown in FIG. 2) may extend through a center point 410 of the shield back end 204.

The rim 210 of the shield back end 204 is a slotted rim. The rim 210 extends radially away from the center point 410 and has a rim width 326 in a direction that extends radially away from the center point 410. In one embodiment, rim 210 may extend around a portion, and less than all, of the transition portion 224 of the housing 102. For example, the rim 210 may include a plurality of rim ends 312, 314 separated from one another by a gap 308. In the illustrated embodiment, the rim 210 includes atop rim portion 304 and a bottom rim portion 306 separated from one another by a pair of gaps 308, 310. The top rim portion 304 may extend between top rim portion ends 312, 318. The bottom rim portion 306 may extend between bottom rim portion ends 314. 320. The gaps 308, 310 may expose arcuate portions 322, 324 of the transition portion 224. In embodiments where the transition portion 224 is not circular, the arcuate portions 322, 324 may have non-arcuate portions and may include the portions of the transition portion 224 between the rim ends 312, 314 and between the rim ends 318, 320. The portions 322, 324 of the transition portion 224 that are exposed may have an exposed portion width 328. The exposed portion width 328 may include the width of the transition portion 224 that is not covered by the rim 210. For example, the exposed portion width 328 may include the width of a portion of the transition portion 224 that is visible from the viewpoint illustrated in FIG. 3. In the illustrated embodiment, the exposed portion width 328 is greater than the rim width 326 in directions that extend radially away from the center point 410. In another embodiment, the exposed portion width 328 is less than or approximately equal to the rim width 326 in directions that extend radially away from the center point 410.

In the illustrated embodiment, the top and bottom rim portions 304, 306 are arcuate portions of the rim 210 that oppose one another. The gaps 308, 310 also oppose one another in the illustrated embodiment. In another embodiment, the rim 210 does not have a circular shape and the top and bottom rim portions 304, 306 do not have arcuate shapes. For example, the rim 210 may have a square or rectangular shape and the top and bottom rim portions 304, 306 may be portions of the square or rectangular shape. Other shapes of the rim 210 and top and bottom rim portions 304, 306 are possible as well. In one embodiment, the top and bottom rim portions 304, 306 are approximately the same size and the gaps 308, 310 are approximately the same size.

While only two gaps 308, 310 and the top and bottom rim portions 304, 306 are shown in the illustrated embodiment, a different number of gaps 308, 310 and top and bottom rim portions 304, 306 may be provided. For example, in one embodiment, only one of the gaps 308, 310 is provided. In such an embodiment, the rim 210 may extend around a portion of the periphery of the shield back end 204 with the gap 310 omitted and the gap 308 separating top rim portion end 312 and bottom rim portion end 314. In another embodiment, more than two gaps 308, 310 and more than the two top and bottom rim portions 304, 306 maybe provided. In one embodiment, the top and bottom rim portions 304, 306 do not oppose one another and the gaps 308, 310 do not oppose one another. In another embodiment, the top and bottom rim portions 304, 306 are not provided at the top and bottom of the shield back end 204 and the gaps 308, 310 are not provided at the sides of the shield back end 204.

The gaps 308, 310 may be created by removing portions of the rim 210 before or after the shield 104 (shown in FIG. 1) is inserted into the housing 102 (shown in FIG. 1). In another embodiment, the gaps 308, 310 may be provided by machining the gaps 308, 310 from the rim 210 when the shield 104 is machined from a stock of conductive material. In another embodiment, the gaps 308, 310 may be provided by not tilling in corresponding portions of a mold in a die casting process used to create the shield 104.

In one embodiment, the gap 308 is located proximate to the ground contact opening 302. For example, the ground contact opening 302 may be closer to the gap 308 than one or more of the dielectric holder opening 208, the dielectric 200, the signal contact opening 216 and the signal contact 202. The gap 308 may be provided near the ground contact opening 302 to provide a path for flash or other waste material of the shield 104 (shown in FIG. 1) to be removed from the shield back end 204. The waste silvers may be removed from the shield back end 204 by providing the gap 308 near the ground contact opening 302. Rather than be held near the shield hack end 204 by the rim 210, the waste slivers may fell away from the shield back end 204 through the gap 308. For example, the shield 104 may be positioned during the manufacture of the shield 104 so that gravity pulls the waste slivers down through the gap 308 or the gap 310. In another example, air or another fluid may be used to flush the waste slivers away from the shield back end 204 and through one or more of the gaps 308, 310.

In one embodiment providing the gap 308 in a location that is proximate to the ground contact opening 302 provides a clearance for flaring the top and bottom rim portions 304, 306. For example, if the rim 210 did not include the gap 308 near the ground contact opening 302, only a very thin flaring tool could be inserted between the ground contact opening 302 and the rim 210 in order to flare the rim 210 towards the housing 102 (shown in FIG. 1). However, with the gap 308 near the ground contact opening 302 in one or more embodiments, a more robust flaring tool can be used to flare the top and bottom rim portions 304, 306 towards the housing 102, as shown in FIG. 2.

In one embodiment, the sectioning of the rim 210 into portions may reduce the force required to flare the rim 210 towards the housing 102, as shown in FIG. 2. For example, providing the gaps 308, 310 in the rim 210, thereby creating the top and bottom rim portions 304, 306, may reduce the force required to bend the top and bottom rim portions 304, 306 towards the housing 102.

Figure 4:
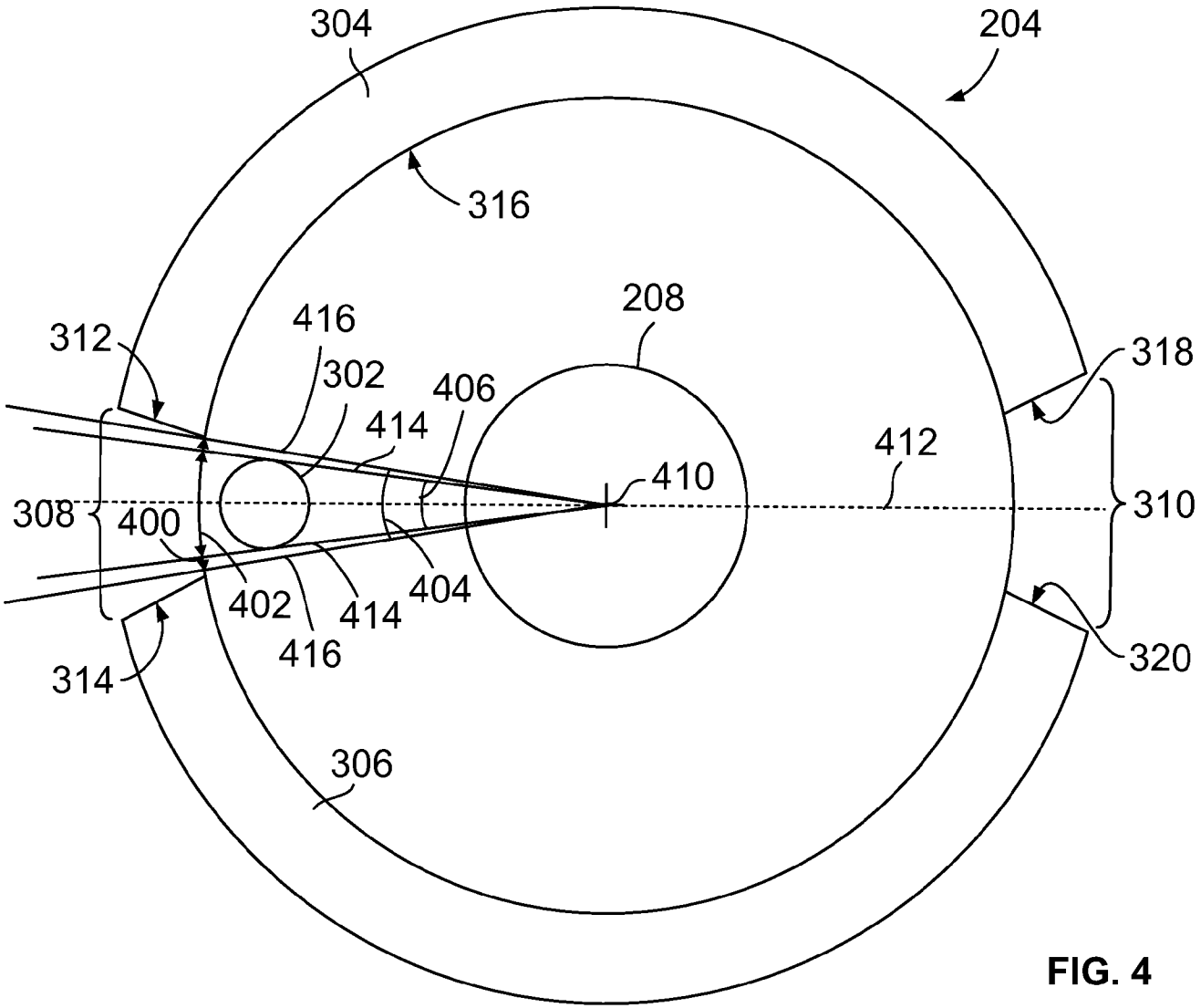
FIG. 4 is an elevational view of a shield back end shown in FIG. 2 with a signal contact also shown in FIG. 2 and a ground contact shown in FIG. 3 removed from the drawing.

FIG. 4 is an elevational view of the shield back end 204 with the signal contact 202 (shown in FIG. 2) and the ground contact 300 (shown in FIG. 3) removed. In the illustrated embodiment, each of the gap 308, the gap 310, the ground contact opening 302 and the dielectric holder opening 208 is centered on a center axis 412. In the illustrated embodiment, the center axis 412 is substantially perpendicular to the longitudinal axis 246 (shown in FIG. 2). The center axis 412 may extend through the center point 410 of the shield back end 204. In one embodiment, the center point 410 is located at the center of the shield back end 204.

In one embodiment, the top rim portion end 312 and the bottom rim portion end 314 are separated by a separation distance that is larger than the ground contact opening 302. The top rim portion end 318 and the bottom rim portion end 320 also may be separated by a separation distance that is larger than the ground contact opening 302. For example, each of the gaps 308, 310 may be at least as wide as the ground contact opening 302. In one embodiment, a gap arcuate width 400 of the gap 308 may be greater than an opening arcuate width 402 of the ground contact opening 302. The gap arcuate width 400 includes the minimum arcuate distance along an outside periphery 316 of the shield back end 204 that a gap angle 404 subtends. For example, the gap arcuate width 400 may be an arc along the outside periphery 316 of the shield back end 204 that is represented by the gap arcuate width 400 and that is the minimum distance between the top rim portion end 312 and the bottom rim portion end 314 along the outside periphery 316. In the illustrated embodiment, the gap angle 404 is defined by two gap lines 416 that extend radially from the center point 410 to the rim ends 312, 314 at the points where the rim ends 312, 314 are closest to one another. The opening arcuate width 402 includes the minimum arcuate distance along the outside periphery 316 that an opening angle 406 subtends. For example, the opening angle 406 may subtend an arc along the outside periphery 316 that is represented by the opening arcuate width 402 and that is the minimum angle that spans across and includes the ground contact opening 302. For example, the opening angle 406 may be sufficiently large to tangentially contact the ground contact opening 302. As shown in the illustrated embodiment, the opening angle 406 is formed by two radial lines 414 that are each tangent to the ground contact opening 302. Both the gap and opening angles 404, 406 may be measured from the center point 410 of the shield back end 204.

Figure 5:
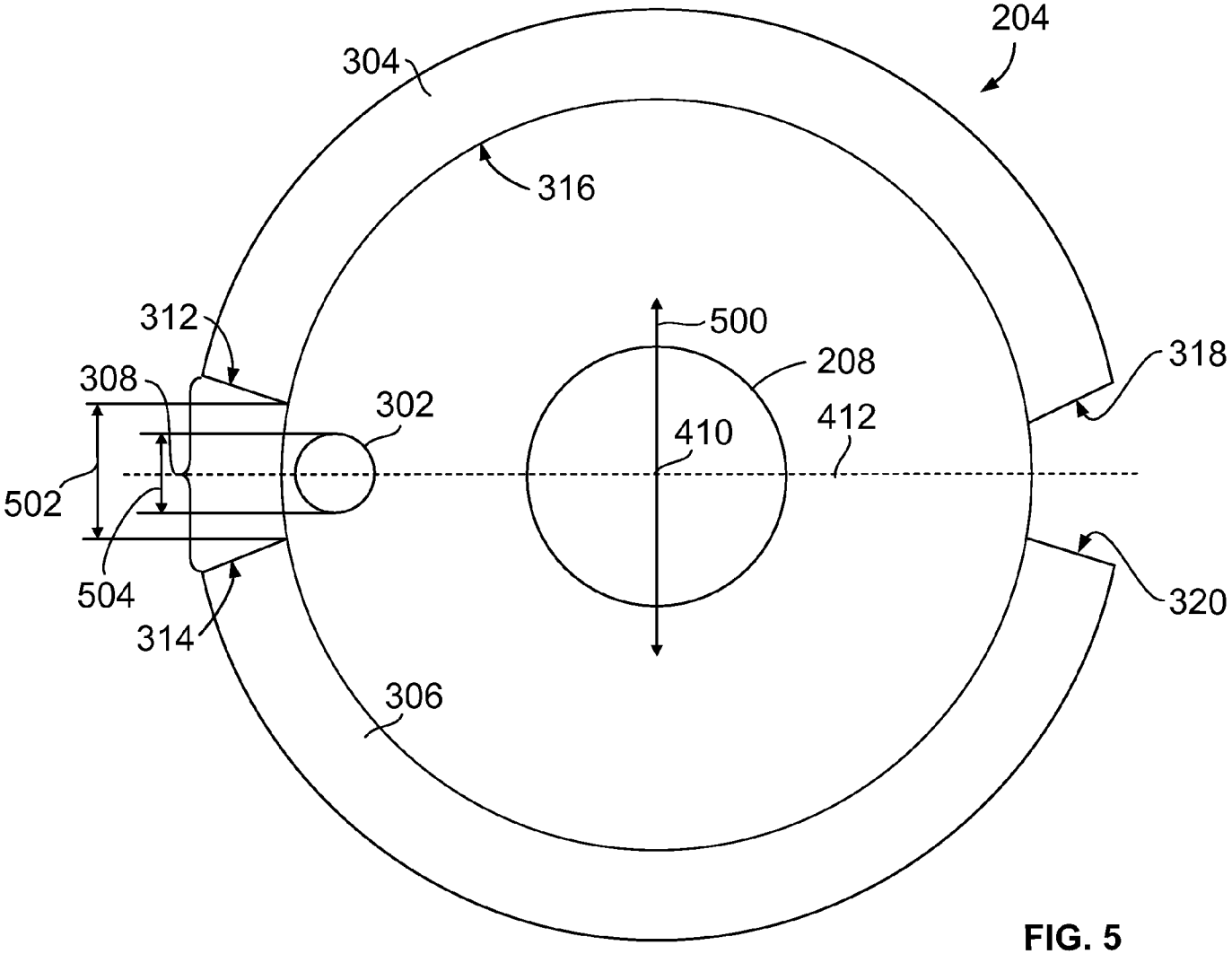
FIG. 5 is another elevational view of the shield back end shown in FIG. 2 with the signal contact also shown in FIG. 2 and the ground contact shown in FIG. 3 removed.

FIG. 5 is another elevational view of the shield back end 204 with the signal contact 202 (shown in FIG. 2) and the ground contact 300 (shown in FIG. 3) removed. In the illustrated embodiment, each of the gap 308, the ground contact opening 302 and the dielectric holder opening 208 is centered on the center axis 412. The center axis 412 extends through the center point 410. A transverse axis 500 of the shield back end 204 also extends through the center point 410. In one embodiment, the transverse axis 500 is perpendicular to the center axis 412. In another embodiment, the transverse and center axes 500, 412 are acute or obtuse to one another.

In one embodiment, the top and bottom rim portions 304, 306 are separated by a linear separation distance 502 that is at least as great as a diameter 504 of the ground contact opening 302. The diameter 504 may be the inside diameter of the ground contact opening 302 at the shield back end 204 and measured across the inside of the ground contact opening 302. The linear separation distance 502 may be the minimum distance between the top rim portion end 312 and the bottom rim portion end 314 in a direction that is substantially parallel to the transverse axis 500. The linear separation distance 502 may be the minimum distance between the top rim portion end 318 and the bottom rim portion end 320 in a direction that is substantially parallel to the transverse axis 500.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used, merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a housing having an interior chamber comprising an inner surface extending between a housing mating end and a housing back end, the housing mating end configured to mate with a mating electrical connector, the inner surface having loading and transition portions, the loading portion located proximate to the housing mating end, the transition portion located proximate to the housing back end; and a shield shaped to fit in the interior chamber, the shield extending between a shield mating end and a shield back end, the shield back end comprising a ground contact opening configured to receive a ground contact to electrically connect the shield to an electrical ground, the shield comprising a rim protruding from the shield back end that extends around a portion of an outer periphery of the shield back end, the rim comprising a plurality of rim ends separated by a gap, wherein the rim engages the transition portion to prevent the shield being removed through the housing mating end and the gap exposes a portion of the transition portion.

2. The connector assembly of claim 1, wherein the gap is located proximate to the ground contact opening such that at least some material of the shield that is removed to create the ground contact opening is removed from the shield back end through the gap.

3. The connector assembly of claim 1, wherein the gap exposes a portion of the transition portion having a width extending in a radial direction away from a center point of the shield back end that is greater than a width of the rim extending in the radial direction away from the center point.

4. The connector assembly of claim 1, wherein the gap is wider than the ground contact opening.

5. The connector assembly of claim 1, wherein a gap angle and a ground contact opening angle each subtend an arc along the outer periphery of the shield back end, the are subtended by the gap angle spanning across the gap and being greater than the are subtended by the ground contact opening angle, the ground, contact opening angle defined by two radial lines that extend from the center point and tangentially contact the ground contact opening, the gap angle defined by two gap lines extending between each of the rim ends and the center point.

6. The connector assembly of claim 1, wherein the gap, the ground contact opening and the center point are located on a center axis of the shield back end, the rim ends being separated by a linear separation distance along a transverse axis, the transverse axis being substantially perpendicular to the center axis, the linear separation distance being greater than a diameter of the ground contact opening.

7. The connector assembly of claim 1, wherein the rim comprises first and second rim portions separated by the gap and an opposing gap, the first and second rim portions each extending around different portions of the outer periphery and opposing one another.

8. The connector assembly of claim 1, wherein the transition portion comprises a beveled edge of the inner surface, the inner surface having a cylindrical shape and further comprising a back portion between the loading and transition portions, the back and loading portions separated by a housing shoulder, the inner surface having an inside diameter in the transition portion that decreases from an inside diameter at the housing back end to an inside diameter of the inner surface at an interface between the transition and back portions.

9. The connector assembly of claim 8, wherein the shield comprises an outer surface having an outside diameter that approximates the inside diameter of the inner surface of the housing in the transition portion.

10. The connector assembly of claim 8, wherein the shield comprises an outer surface having a cylindrical shape that is staged in diameter to form first and second portions separated by a shield shoulder, the outer surface having different outside diameters in the first and second portions, the shield shoulder engaging the housing shoulder to prevent the shield from being removed from the housing through the housing back end.

11. An electrical connector assembly comprising:

a housing comprising an interior chamber that extends along a longitudinal axis between a housing mating end and a housing back end, the housing mating end configured to mate with a mating electrical connector;

a shield shaped to fit in the interior chamber, the shield extending along the longitudinal axis between a shield mating end and a shield back end, the shield back end comprising a ground contact opening configured to receive a ground contact to electrically connect the shield to an electrical ground, the shield comprising a rim protruding from the shield back end that extends around a portion of an outer periphery of the shield back end, the rim comprising a plurality of rim ends separated by a gap located proximate to the ground contact opening;

a dielectric holder held within the shield and extending along the longitudinal axis; and a signal contact held within the dielectric holder and substantially extending along the longitudinal axis, each of the housing, shield, dielectric holder and signal contact being coaxial with one another about the longitudinal axis.

12. The connector assembly of claim 11, wherein the housing comprises an inner surface having a beveled edge proximate to the housing back end, the gap exposing a portion of the beveled edge having a width extending in a radial direction away from the longitudinal axis that is greater than a width of the rim extending in the radial direction away from the center point.

13. The connector assembly of claim 11, wherein the gap is wider than the ground contact opening.

14. The connector assembly of claim 11, wherein a gap angle and a ground contact opening angle each subtend an arc along the outer periphery of the shield back end, the arc subtended by the gap angle spanning across the gap and being greater than the arc subtended by the ground contact opening angle, the ground contact opening angle defined by two radial lines that extend from the longitudinal axis and tangentially contact the ground contact opening, the gap angle defined by two gap lines extending between each of the rim ends and the longitudinal axis.

15. The connector assembly of claim 11, wherein the gap, the ground contact opening and the center point are located on a center axis of the shield back end, the rim ends being separated by a linear separation distance along a transverse axis, the longitudinal, transverse and center axes being substantially perpendicular to one another, the linear separation distance being greater than a diameter of the ground contact opening.

16. The connector assembly of claim 11, wherein the rim comprises first and second rim portions separated by the gap and an opposing gap, the first and second rim portions each extending around different portions of the outer periphery and opposing one another.

17. The connector assembly of claim 11, wherein the housing comprises an inner surface that is staged in diameter to form loading, back and transition portions, the transition portion comprising a beveled edge that engages the rim.

18. The connector assembly of claim 17, wherein the loading and back ends are separated by a housing shoulder, the inner surface having a larger inside diameter in the loading portion than in the back portion, the shield engaging the housing shoulder to prevent the shield from being removed from the housing through the housing back end.

19. The connector assembly of claim 11, wherein the housing comprises a mounting end that is substantially perpendicular to the housing mating and back ends, the mounting end configured to be mounted on a circuit board.

20. The connector assembly of claim 19, wherein the signal contact includes an approximately perpendicular bend outside of the connector assembly in a location proximate to the housing back end.

* * * * *